US007301503B1

(12) United States Patent
Rausch

(10) Patent No.: US 7,301,503 B1
(45) Date of Patent: Nov. 27, 2007

(54) WIRELESS COMMUNICATION DEVICE WITH A PATCH ANTENNA SUPPORTING CROSS-POLARIZED ACTIVE ELEMENTS

(75) Inventor: Walter F. Rausch, Shawnee, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 11/464,901

(22) Filed: Aug. 16, 2006

(51) Int. Cl.
*H01Q 1/24* (2006.01)

(52) U.S. Cl. ..... 343/702; 343/700 MS

(58) Field of Classification Search ..... 343/702, 343/700 MS; 455/575
See application file for complete search history.

(56) References Cited

U.S. PATENT DOCUMENTS 6,707,431 B2 * 3/2004 Byun et al. ..... 343/702
2002/0068602 A1 * 6/2002 Kuriyama et al. ..... 455/550
2003/0137464 A1 * 7/2003 Foti et al. ..... 343/770
2006/0055608 A1 * 3/2006 Minemura ..... 343/702
2006/0097927 A1 * 5/2006 Satoh et al. ..... 343/702

* cited by examiner

*Primary Examiner*—Hoang V. Nguyen

(57) ABSTRACT

A wireless communication device comprises a first portion, a second portion, and an axis. The first portion comprises a patch antenna that includes an antenna plate and a ground plate that are separated by a dielectric. The antenna plate has orthogonal antenna elements that are configured to transmit and receive cross-polarized wireless signals. The second portion is configured to be handheld by a user. The axis is coupled to the first portion and the second portion. The axis allows the user to rotate the first portion and the second portion relative to one another to open and close the wireless communication device.

20 Claims, 4 Drawing Sheets

WIRELESS COMMUNICATION DEVICE WITH A PATCH ANTENNA SUPPORTING CROSS-POLARIZED ACTIVE ELEMENTS

RELATED APPLICATIONS

Not applicable

FEDERALLY SPONSORED RESEARCH OR DEVELOPMENT

Not applicable

MICROFICHE APPENDIX

Not applicable

BACKGROUND OF THE INVENTION

1. Field of the Invention

The invention is related to communications, and in particular, to patch antennas for wireless communication devices.

2. Description of the Prior Art

Wireless communication devices are used by millions of people to communicate as they move around. These wireless communication devices provide many communication services, such as telephony and Internet access. To provide these communication services, wireless communication devices include antennas that exchange wireless communication signals with network systems. Some wireless communication devices have two antennas to provide wireless signal diversity. Wireless signal diversity is desirable, because if one wireless signal fades, the other wireless signal can still reach the receiving antenna.

In one antenna design, two antennas are arranged in parallel. For example, a "flip" type telephone may have two vertical antennas that are arranged in parallel in the upper portion of the telephone. Unfortunately, this antenna design has poor de-correlation. With poor de-correlation, the wireless communication signals from each antenna are too similar to provide adequate diversity. As a result, this type of antenna design does not effectively support advanced antenna techniques that require good de-correlation.

In another antenna design, two antennas are arranged perpendicular to one another. For example, a "flip" type telephone may have two perpendicular antennas, one in the upper portion of the telephone, and the other in the lower portion of the telephone. Unfortunately, this antenna design has poor equivalent gain. With poor equivalent gain, the signal strength in the channels of the wireless communication signal is different across the channels. As a result, this type of antenna design does not effectively support advanced antenna techniques that require good equivalent gain.

One example of an advanced antenna technique is referred to as Multiple Input Multiple Output (MIMO). MIMO antennas exchange multiple wireless communication signals for increased throughput as compared to a single channel. MIMO antennas provide excellent reliability and improved throughput by providing diverse signal paths. However, MIMO antennas require good equivalent gain and good de-correlation. Unfortunately, the antenna designs described above do not effectively support MIMO. Patch antennas with cross-polarized elements have good equivalent gain and good de-correlation. Thus, cross-polarized patch antennas could support advanced antenna techniques, such as MIMO. Unfortunately, current parch antennas are too large for use in relatively small wireless communication devices.

SUMMARY OF THE INVENTION

Examples of the invention include a wireless communication device. The wireless communication device comprises a first portion, a second portion, and an axis. The first portion comprises a patch antenna that includes an antenna plate and a ground plate that are separated by a dielectric. The antenna plate has orthogonal antenna elements that are configured to transmit and receive cross-polarized wireless signals. The second portion is configured to be handheld by a user. The axis is coupled to the first portion and the second portion. The axis allows the user to rotate the first portion and the second portion relative to one another to open and close the wireless communication device.

In some examples of the invention, the antenna plate has a square shape that is less than two square inches.

In some examples of the invention, the antenna plate has a square shape that is less than three square inches.

In some examples of the invention, the wireless communication device comprises a mobile communication device.

In some examples of the invention, the wireless communication device is configured to use Multiple Input Multiple Output (MIMO) to transmit and receive the cross-polarized wireless signals.

In some examples of the invention, the wireless communication device is configured to use diversity to transmit and receive the cross-polarized wireless signals.

In some examples of the invention, the first portion includes a speaker.

In some examples of the invention, the first portion includes a display screen.

In some examples of the invention, the second portion includes a microphone.

In some examples of the invention, the second portion includes input buttons, a battery, and a microprocessor.

In some examples of the invention, the antenna plate comprises a flat metal surface.

In some examples of the invention, the patch antenna has a square shape and is configured to transfer excitation signals at adjacent corners of the square shape.

In some examples of the invention, the patch antenna has a square shape and is configured to reference ground signals from adjacent corners of the square shape.

In some examples of the invention, the wireless communication device comprises a cellular telephone.

In some examples of the invention, the wireless communication device comprises an Internet appliance.

In some examples of the invention, the wireless communication device comprises a handheld computer.

In some examples of the invention, the wireless communication device uses Code Division Multiple Access (CDMA) to transmit and receive the cross-polarized wireless signals.

In some examples of the invention, the wireless communication device uses Global System for Mobile communications (GSM) to transmit and receive the cross-polarized wireless signals.

In some examples of the invention, the wireless communication device uses WiFi to transmit and receive the cross-polarized wireless signals.

In some examples of the invention, the wireless communication device uses WiMAX to transmit and receive the cross-polarized wireless signals.

BRIEF DESCRIPTION OF THE DRAWINGS

The same reference number represents the same element on all drawings.

DETAILED DESCRIPTION OF THE PREFERRED EMBODIMENT

Figure 1:
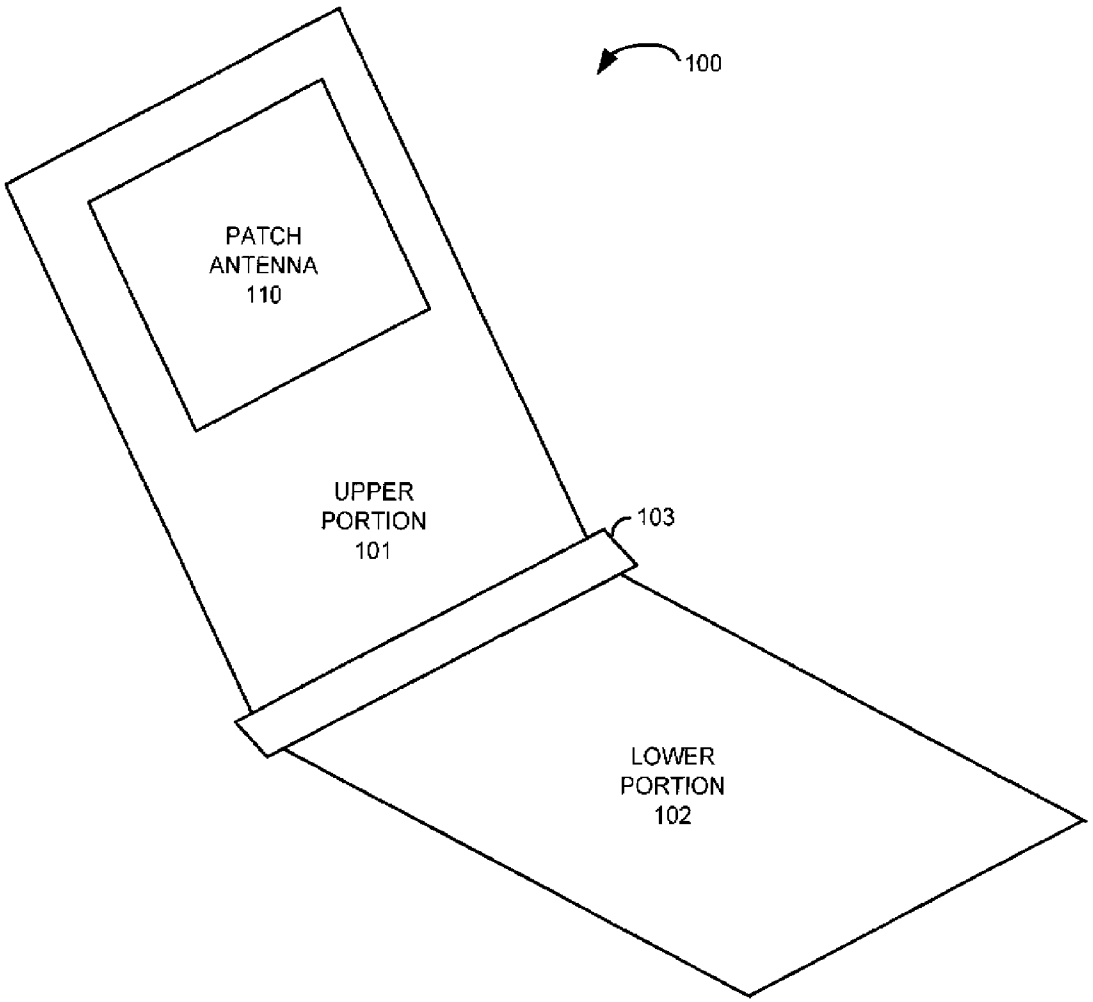
FIG. 1 illustrates a wireless communication device in an example of the invention.

FIG. 1 illustrates wireless communication device 100 in an example of the invention. Wireless communication device 100 is a mobile, handheld device, which means that it has a size and weight that are suitable for a person to carry around and operate. Examples of wireless communication device 100 include cellular telephones, WiFi telephones, WiMAX telephones, smart telephones, mobile Internet appliances, handheld computers, and personal digital assistants, although there could be other examples.

Wireless communication device 100 includes first portion 101, second portion 102, and axis 103. Axis 103 is connected to first portion 101 and to second portion 103. Axis 103 allows first portion 101 and second portion 102 to rotate relative to one another about axis 103, so the surfaces of portions 101-102 may rotate together to close or rotate apart to open. An example of this configuration is the "flip-phone" design.

First portion 101 comprises a housing, such as a plastic enclosure. First portion 101 includes patch antenna 110. First portion 101 also typically includes circuitry and user interfaces. For example, first portion 101 might include a speaker, a display screen, and associated electronics. Other user interfaces, such as dials, touch screens, ports, microphones, and input buttons, could also be included. First portion 101 may also include other components, such as batteries, microprocessors, memories, and associated electronics.

Second portion 102 also comprises a housing, such as a plastic enclosure. Second portion 102 also typically includes circuitry and user interfaces. For example, second portion 102 might include a microphone, input buttons, and associated electronics. Other user interfaces, such as dials, touch screens, and ports, could also be included. Second portion 102 may also include other components, such as batteries, microprocessors, memories, and associated electronics.

A user operates wireless communication device 100 by rotating first and second portions 101-102 away from one another to open device 100. The user then activates and controls the appropriate user interfaces to obtain the desired communication service. To provide the communication service, wireless communication device 100 exchanges wireless communication signals with other wireless systems (not shown) over the air. Wireless communication device 100 uses patch antenna 110 to exchange these wireless signals over the air.

Wireless communication device 100 may use various parts of the Radio Frequency (RF) spectrum for wireless communications. Wireless communication device 100 may use various protocols for wireless communications, such as Code Division Multiple Access (CDMA), Global System for Mobile communications (GSM), WiFi, WiMAX, satellite, or some other protocol. Wireless communication device 100 may use wireless communications to provide various applications, such as audio transfer, video transfer, telephony, Internet access, instant messaging, push-to-talk, email, private data service, location service, or some other application.

Figure 2:
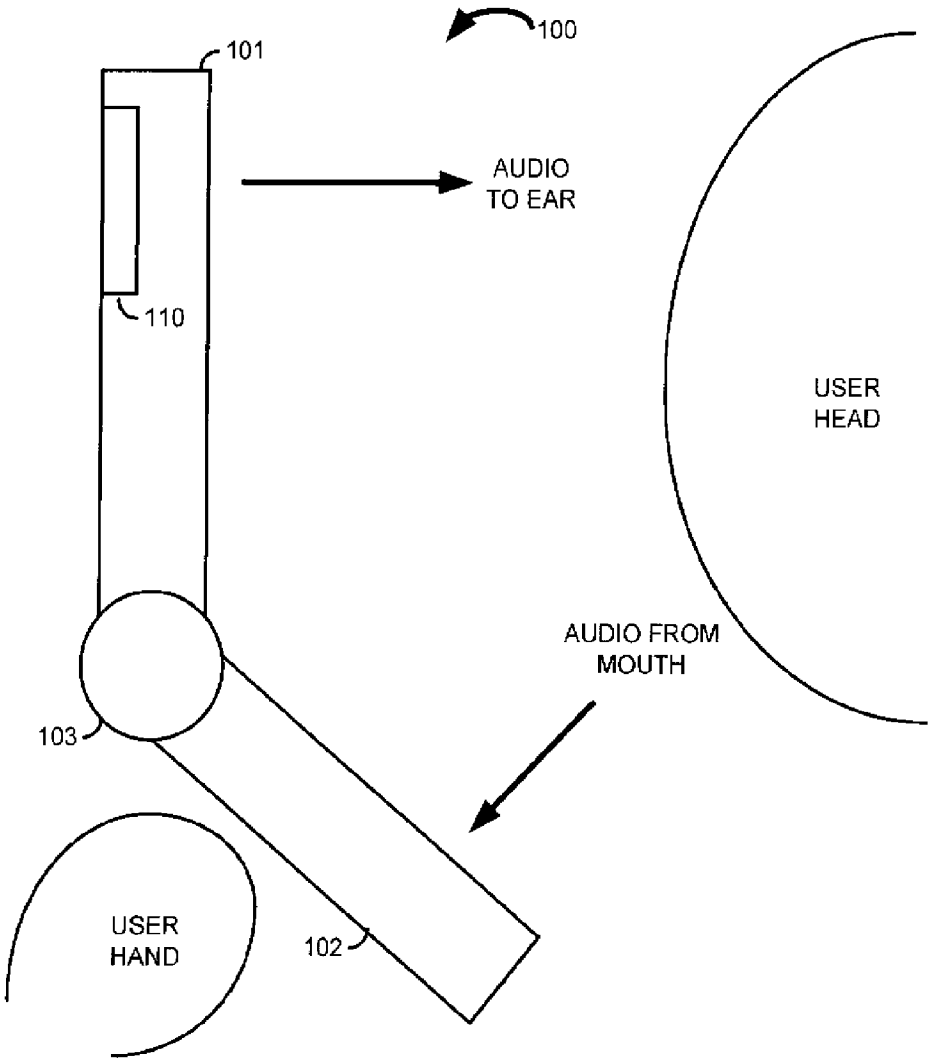
FIG. 2 illustrates the wireless communication device in an example of the invention.

FIG. 2 illustrates wireless communication device 100 in an example of the invention. Wireless communication device 100 includes first portion 101, second portion 102, and axis 103 as described above. First portion 101 includes patch antenna 110. For a telephony application, the user listens to a speaker in first portion 101 and speaks into a microphone in second portion 102. Note how the user would hold device 100 by holding second portion 102 in their hand instead holding of first portion 101. Advantageously, holding second portion 102 keeps hand capacitance as far as possible from patch antenna 110 in first portion 101. To improve the separation from hand capacitance, patch antenna 110 should be positioned away from second portion 101 (toward the top of first portion 101). To prevent interference, patch antenna 110 should also be positioned away from the head of the user (toward the back of first portion 101).

Figure 3:
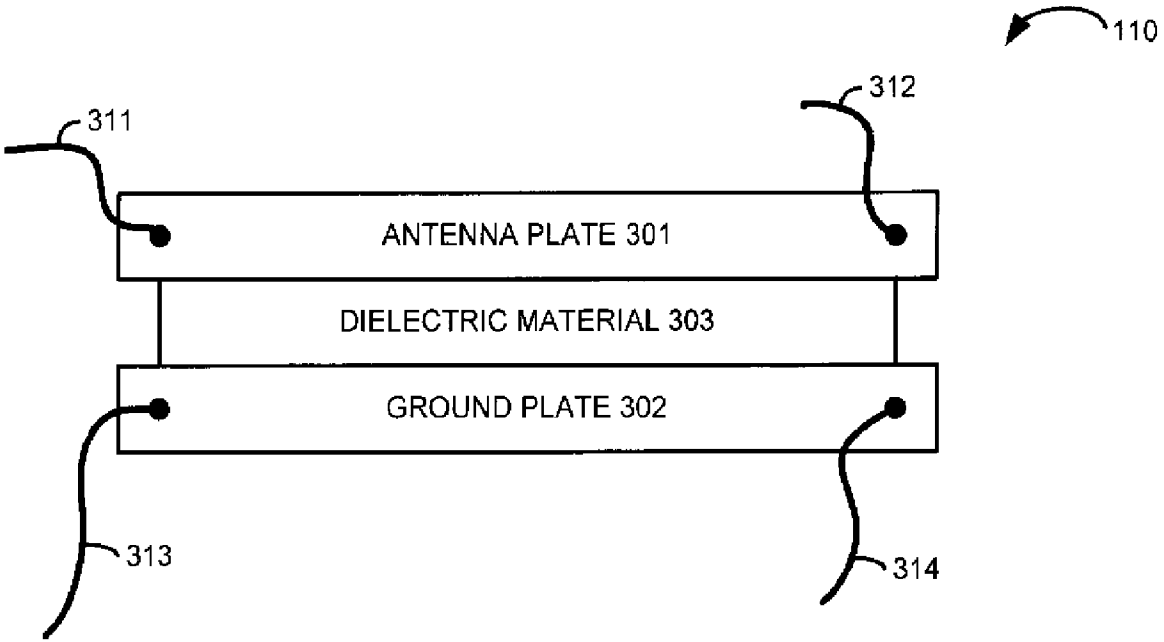
FIG. 3 illustrates a patch antenna in an example of the invention.

FIG. 3 illustrates patch antenna 110 in an example of the invention. Patch antenna 110 includes antenna plate 301, ground plate 302, and dielectric material 303. Dielectric material 303 connects antenna plate 301 to ground plate 302 in a sandwich fashion. Dielectric material 303 is designed to lower the resonant frequency and reduce the size of plates 301-302. Plates 301-302 could be formed as flat, square, metal surfaces, although other suitable shapes and materials could be used. Plates 301-302 could be sized as a one inch square, a two inch square, a three inch square, or some other dimension in between. Antenna plate 301 is connected to signal paths 311-312. Ground plate 302 is connected to ground paths 313-314. Paths 311-314 are coupled to communication electronics (not shown) in wireless communication device 100.

Figure 4:
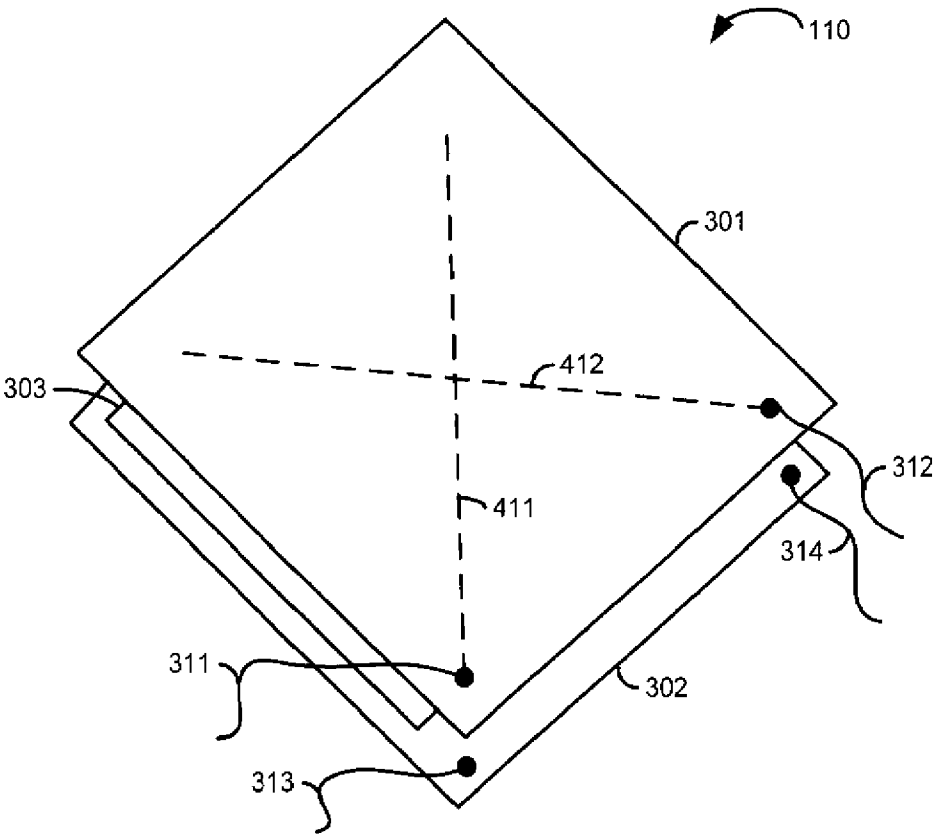
FIG. 4 illustrates a patch antenna in an example of the invention.

FIG. 4 illustrates patch antenna 110 in an example of the invention. Patch antenna 110 includes antenna plate 301, ground plate 302, and dielectric material 303 as described above. Patch antenna 110 is connected to signal paths 311-312 and ground paths 313-314 as described above. Communication electronics in wireless communication device 100 (not shown) transfer electrical RF excitation signals over signal paths 311-312 to antenna plate 301. The electrical RF excitation signals from signal paths 311-312 drive patch antenna 110 to transmit corresponding wireless communication signals. The excitation signals are referenced to ground through dielectric material 303, ground plate 302, and ground paths 313-314.

Specifically, the RF excitation signal from signal path 311 energizes antenna element 411 on antenna plate 301. The RF excitation signal from signal path 312 energizes antenna element 412 on antenna plate 301. Thus, the surface of patch antenna 110 provides two separate antenna elements 411-412. Antenna elements 411-412 transmit the corresponding wireless communication signals. Antenna elements 411-412 also receive wireless communication signals. Antenna elements 411-412 convert the received wireless communication signals into electrical RF signals. Antenna elements 411-412 transfer the electrical RF signals over signal paths 311-312 to communication electronics in device 100 (not shown).

The use of a patch antenna design having to plates 301-302 separated by a dielectric 303 provides equivalent gain. Equivalent gain means that the same average energy is present across all channels in the wireless communication signals transmitted and received by both elements 411-412 of patch antenna 110. The same average energy means that the average signal strength of each channel in the wireless communication signals remains within 4 dB in each respective signal path. Advantageously, this type of equivalent gain is required for many advanced wireless communication techniques.

Note that antenna paths 411-412 are perpendicular (offset by 90 degrees), so they transmit and receive cross-polarized wireless communication signals. The connection of signal paths 311-312 at adjacent corners of antenna plate 301 cause the perpendicular antenna paths 411-412 that provide the cross-polarized wireless communication signals. Advantageously, the cross-polarized wireless communication signals provide good de-correlation. Good de-correlation is required for some advanced wireless communication techniques.

Multiple Input Multiple Output (MIMO) is one example of a wireless communication technique enabled by patch antenna 110. MIMO has a higher throughput and better reliability than many other wireless communication techniques. Wireless communication device 100 could use MIMO for wireless communication through patch antenna 110.

Spatial diversity is another example of a wireless communication technique enabled by patch antenna 110. Spatial diversity uses multiple physical signal paths and has better reliability than many other wireless communication techniques. Wireless communication device 100 could use spatial diversity for wireless communication through patch antenna 110.

Advantageously, patch antenna 110 provides good de-correlation and good equivalent gain to wireless communication device 100. The good de-correlation and the good equivalent gain allow wireless communication device 100 to use advanced antenna techniques, such as MIMO. The use of the dielectric allows patch antenna 110 to fit within a handheld device. Thus, wireless communication device 100 has better throughput and better reliability than similar handheld wireless devices with conventional antenna designs.

I claim:

1. A wireless communication device comprising:

a first portion including a patch antenna that includes an antenna plate and a ground plate that are separated by a dielectric wherein the antenna plate has orthogonal antenna elements that are configured to transmit and receive cross-polarized wireless signals;

a second portion that is configured to be handheld by a user;

an axis coupled to the first portion and the second portion and that allows the user to rotate the first portion and the second portion relative to one another to open and close the wireless communication device.

2. The wireless communication device of claim 1 wherein the antenna plate has a square shape that is less than two square inches.

3. The wireless communication device of claim 1 wherein the antenna plate has a square shape that is less than three square inches.

4. The wireless communication device of claim 1 wherein the wireless communication device comprises a mobile communication device.

5. The wireless communication device of claim 1 wherein the wireless communication device is configured to use Multiple Input Multiple Output (MIMO) to transmit and receive the cross-polarized wireless signals.

6. The wireless communication device of claim 1 wherein the wireless communication device is configured to use diversity to transmit and receive the cross-polarized wireless signals.

7. The wireless communication device of claim 1 wherein the first portion includes a speaker.

8. The wireless communication device of claim 1 wherein the first portion includes a display screen.

9. The wireless communication device of claim 1 wherein the second portion includes a microphone.

10. The wireless communication device of claim 1 wherein the second portion includes input buttons, a battery, and a microprocessor.

11. The wireless communication device of claim 1 wherein the antenna plate comprises a flat metal surface.

12. The wireless communication device of claim 1 wherein the patch antenna has a square shape and is configured to transfer excitation signals at adjacent corners of the square shape.

13. The wireless communication device of claim 1 wherein the patch antenna has a square shape and is configured to reference ground signals from adjacent corners of the square shape.

14. The wireless communication device of claim 1 wherein the wireless communication device comprises a cellular telephone.

15. The wireless communication device of claim 1 wherein the wireless communication device comprises an Internet appliance.

16. The wireless communication device of claim 1 wherein the wireless communication device comprises a handheld computer.

17. The wireless communication device of claim 1 wherein the wireless communication device uses Code Division Multiple Access (CDMA) to transmit and receive the cross-polarized wireless signals.

18. The wireless communication device of claim 1 wherein the wireless communication device uses Global System for Mobile communications (GSM) to transmit and receive the cross-polarized wireless signals.

19. The wireless communication device of claim 1 wherein the wireless communication device uses WiFi to transmit and receive the cross-polarized wireless signals.

20. The wireless communication device of claim 1 wherein the wireless communication device uses WiMAX to transmit and receive the cross-polarized wireless signals.

* * * * *